US005108094A

United States Patent [19]

Quinn et al.

[11] Patent Number: 5,108,094

[45] Date of Patent: Apr. 28, 1992

[54] COMFORT CUSHION FOR FLOORS

[75] Inventors: Edwin J. Quinn; William E. Irwin; Thomas C. Downey, all of Lancaster, Pa.

[73] Assignee: Armstrong World Industries, Inc., Lancaster, Pa.

[21] Appl. No.: 197,295

[22] Filed: May 23, 1988

Related U.S. Application Data

[63] Continuation of Ser. No. 862,267, May 12, 1986, abandoned.

[51] Int. Cl.[5] ..... A63K 3/04

[52] U.S. Cl. ..... 482/121; 52/177; 482/14; 482/23; 472/92

[58] Field of Search ..... 272/93, 96, 109, 56.5, 272/DIG. 9, 66; 5/417; 52/177, 388; 128/62 R, 25 B

[56] References Cited

U.S. PATENT DOCUMENTS 3,434,715 3/1969 Brantingham et al. ..... 272/93

3,603,430 9/1971 Kendall ..... 272/109

4,727,697 3/1988 Vaux ..... 272/109

FOREIGN PATENT DOCUMENTS 3411547 10/1984 Fed. Rep. of Germany ..... 52/177

*Primary Examiner*—Richard J. Apley

*Assistant Examiner*—Jerome Donnolly

[57] ABSTRACT

The invention is directed to a comfort cushion adapted for use by a person standing for a prolonged period. The cushion causes increased leg muscle activity that results in increased movement of blood upward from the feet of the standing person. The cushion is composed of a wear layer which is resistant to abrasion from foot traffic and a base material which is substantially more compressible than the wear layer. The comfort cushion causes the foot to assume a slightly different angular relationship to the horizontal as compared with the conditions that exist when one is standing on a conventional flat floor. This, in turn, causes increased leg muscle activity.

5 Claims, 1 Drawing Sheet

COMFORT CUSHION FOR FLOORS

CROSS-REFERENCE TO RELATED APPLICATION

This is a continuation of application Ser. No. 862,267, filed May 12, 1986, now abandoned.

BACKGROUND OF THE INVENTION

1. Field of the Invention

The invention relates to floor surfaces and, more particularly, to a form thereof, affording greater comfort to persons whose occupation requires substantially constant standing at a given location, as at a desk or counter, or at the operating station of a machine.

2. Description of the Prior Art

The invention herein is an improvement over the "STRESS-REDUCING FLOOR SURFACE" described in U.S. Pat. No. 3,434,715, issued Mar. 25, 1969.

SUMMARY OF THE INVENTION

The invention is a comfort cushion adapted for use by a person standing for a prolonged period. The cushion causes increased leg muscle activity that results in increased movement of blood upward from the feet of the standing person. The cushion comprises a wear layer means which is resistant to abrasion from foot traffic and a base material disposed below the wear layer and being substantially more compressible than the wear layer. The improvement herein is that the wear layer is made of a sheet plastic material having sufficient flexibility to yield under the weight of the average person in shoes without tearing or being perforated. The wear layer has a total percent elongation ranging from about 225 to 300 and the wear layer further has a tensile strength ranging from 1,950 to 2,150 pounds per square inch. The base is a foam plastic material with sufficient ability to deform under the weight of the average person and yet not deform under said weight to the point that the base will not substantially recover to its original undeformed height. The base has a density ranging from about 5 to 7 pounds per cubic foot with a percent compression set no greater than 42. The base has a compression resistance of about 2 pounds per square inch and further, the base has a pattern of depressed areas formed in the side of the base opposite from the side of the base having the wear layer.

DESCRIPTION OF THE PREFERRED EMBODIMENT

Figure 1:
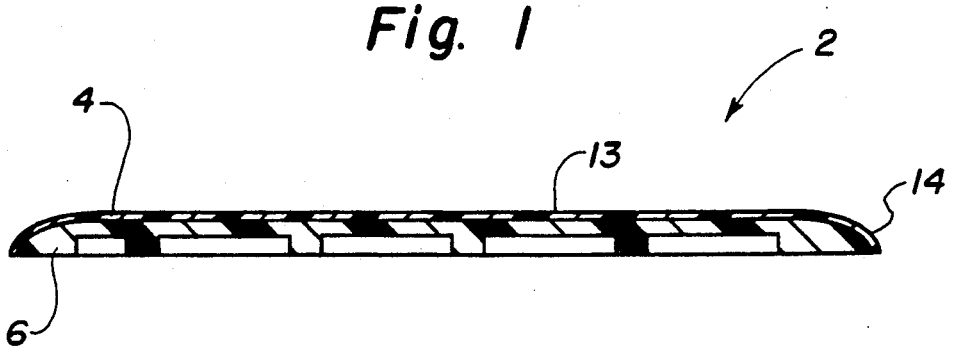
FIG. 1 is a cross section of the comfort cushion herein.

A comfort cushion 2, FIG. 1, is adapted for use by a person standing for a prolonged period wherein said cushion causes increased leg muscle activity that results in increased movement of blood upward from the feet of the standing person. This phenomenon of increased leg muscle activity and blood flow is fully described in columns 1 and 2 of U.S. Pat. No. 3,434,715.

The comfort cushion herein is composed of a wear layer 4 which is resistant to abrasion from foot traffic.

Disposed below the wear layer 4 is a base material 6 that is substantially more compressible than the wear layer.

The improvment herein is in the structure of the wear layer and base material. The wear layer is a sheet plastic material having sufficient flexibility to yield under the weight of the average person in shoes without tearing or being perforated by the weight or shoes of the person. The wear layer has a total percent elongation ranging from about 225 to 300 and the wear layer has a tensile strength ranging from about 1,950 to 2,150 pounds per square inch The base is a foam plastic material with sufficient ability to deform under the weight of the average person and yet not deform under said weight to the point that the base will not substantially recover to its original undeformed height. The base has a density ranging from about 5 to 7 pounds per cubic foot with a percent compression set no greater than 42. The base has a compression resistance of about 2 pounds per square inch. The compression resistance of the wear layer is about 250 pounds per square inch so it can be seen that the base material is substantially more compressible than the wear layer.

Finally, the base layer has a pattern of depressed areas (see FIG. 3) formed in the side of the base material opposite from the side of the base material having the wear layer.

Figure 2:
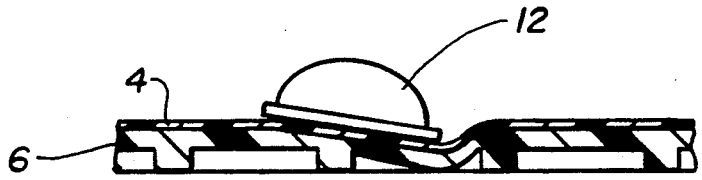
FIG. 2 is a cross section of the comfort cushion herein showing a foot positioned thereon.
Figure 3:
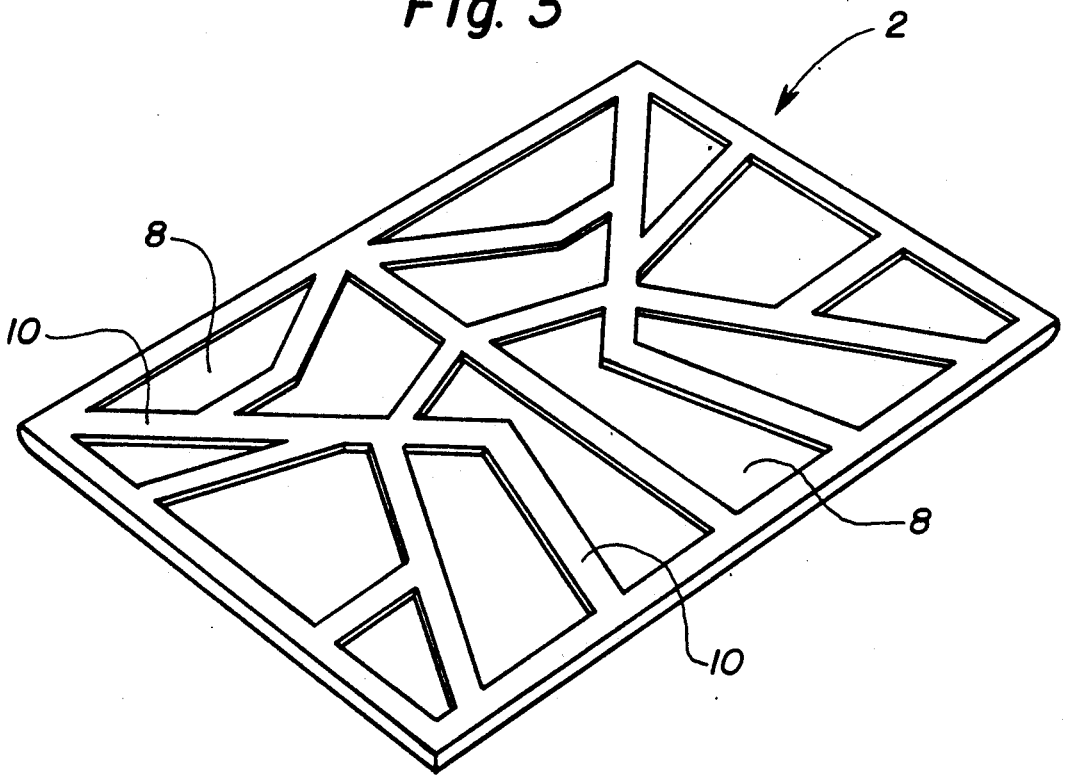
FIG. 3 is a showing of the pattern of depressed areas formed in the back side of the base.

Referring now to FIG. 3 there is shown the surface of the base containing the depressed areas. This is, in effect, showing the bottom view of FIG. 1. The pattern of depressed areas are characterized by having a series of areas of lesser resilient resistance to the weight of the average person in shoes standing thereupon separated by elongated areas of greater resilient resistance to said weight. The areas of lesser resilient resistance are the areas 8 which are depressed areas. The areas of greater resilient resistance to weight are the raised areas or areas 10 of FIG. 3. The width of the areas of lesser resilient resistance are not greater than the width of the forefoot portion of the shoe of a person standing thereon. The width of the areas of greater resilient resistance are not greater than half the width of the forefoot portion of the shoe of the person standing thereon. The preferred form is to have the raised areas 10 about one inch in width and the depressed areas 8 about four inches in width. The difference in resilient resistance between said areas of lesser and greater resilient resistance are such that when subjected to the weight of a person in shoes standing thereon and engaging portions of one each of both opposite areas, the resulting angularity of the foot will be between 0.9° to 1.4° from the horizontal. When the pressure of the foot contacts the thicker raised areas, the compression resistance is 2 pounds per square inch, while in the depressed areas, it is initially zero pounds per square inch. The foot then inclines from the horizontal and the compression resistance builds in the depressed areas until it reaches 2 pounds per square inch. With the compression resistance in both areas being the same, the foot is held in an inclined state. This differential resistance to the foot will cause the foot to tilt from the horizontal and provide a resulting angularity of the foot 12 (FIG. 2) relative the horizontal plane. It is this angularity from the horizontal plane which will be between 0.9° to 1.4° from the horizontal. The angularity will cause the increased leg muscle activity which will then result in increased movement of the blood upward from the feet of the standing person.

The wear layer will be made generally 40 to 85 mils in thickness and the base material will be 8 to 20 times the thickness of the wear layer.

It is possible that the wear layer could have a decorative design placed on the surface 13 thereof. It is also possible that the base material could be made fire-retardant due to the incorporation of a fire-retardant additive being incorporated therein. A typical fire-retardant that could be incorporated in the base layer material is tris(chloropropyl)phosphate.

Finally, it should be noted in FIG. 1 that the wear layer is curved over the edge of the base material to form a ¼ rounded edge 14 on the comfort cushion 2.

It is noted that the wear layer 4 may be composed of plasticized polyvinyl chloride, rubber, urethane elastomers, etc. which are typical materials used to form conventional floor covering products.

It is noted that the base material 6 may be composed of foamed and unfoamed polyvinyl chloride, rubber, polyurethane, polyolefins, etc. which have previously been used to form cushion-type materials which are compressible under the weight of an average person.

What is claimed is:

1. A comfort cushion adapted for use by a person standing for a prolonged period, wherein said cushion causes increased leg muscle activity that results in increased movement of blood upward from the feet of the standing person, said cushion comprising:

(a) a wear layer means which is resistant to abrasion from foot traffic;

(b) a base material disposed below said wear layer and being substantially more compressible than the wear layer; and (c) the improvement comprising:

(1) said wear layer being a sheet plastic material having sufficient flexibility to yield under the weight of the average person in shoes without tearing or being perforated, said wear layer having a total percent elongation ranging from about 225 to 300, further said wear layer having a tensile strength ranging from about 1,950 to 2,150 pounds per square inch, and (2) said base being a cushioned plastic material with sufficient ability to deform under the weight of the average person and yet not deform under said weight to the point that said base will not substantially recover to its original undeformed height, said base having a density ranging from about 5 to 7 pounds per cubic foot with a percent compression set no greater than 42, said base having a compression resistance of about 2 pounds per square inch, and further said base having a pattern of depressed areas formed in the side opposite from the side thereof having the wear layer.

2. A comfort cushion as set forth in claim 1 wherein:

(a) said pattern of depressed areas being characterized by having a series of areas of lesser resilient resistance to the weight of the average person in shoes standing thereon separated by elongated areas of greater resilient resistance to such weight, the width of said areas of lesser resilient resistance being not greater than the width of the forefoot portion of the shoe of a person standing thereon, the width of said areas of greater resilient resistance being not greater than half the width of the forefoot portion of the shoe of a person standing thereon, and the difference in resilient resistance between said areas of lesser and greater resilient resistance being such that when subjected to the weight of a person in shoes standing thereon and engaging portions of one each of both of said areas, the resulting angularity of the foot will be between about 0.9 to 1.4 degrees from the horizontal.

3. A comfort cushion as set forth in claim 2 wherein:

(a) said wear layer being about 40–85 mils in thickness and said base material being about 8 to 20 times the thickness of the wear layer.

4. A comfort cushion as set forth in claim 3 wherein:

(a) said base material being fire retardant due to a fire retardant additive being incorporated therein.

5. A comfort cushion as set forth in claim 4 wherein:

(a) said wear layer is curved over the edge of the base material to form a one-quarter rounded edge on the comfort cushion.

* * * * *